US011181265B2

(12) United States Patent
Ono

(10) Patent No.: US 11,181,265 B2
(45) Date of Patent: Nov. 23, 2021

(54) FLAT BURNER

(71) Applicant: RINNAI CORPORATION, Aichi (JP)

(72) Inventor: Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 60 days.

(21) Appl. No.: 16/676,623

(22) Filed: Nov. 7, 2019

(65) Prior Publication Data

US 2021/0140631 A1 May 13, 2021

(51) Int. Cl.

| | |
|---|---|
| ***F23D 14/26*** | (2006.01) |
| ***F23D 14/82*** | (2006.01) |
| ***F23D 14/28*** | (2006.01) |
| ***F23D 14/02*** | (2006.01) |

(52) U.S. Cl.

CPC ..... *F23D 14/26* (2013.01); *F23D 14/02* (2013.01); *F23D 14/28* (2013.01); *F23D 14/82* (2013.01)

(58) Field of Classification Search

CPC ..... F23D 14/26; F23D 14/02; F23D 14/28; F23D 14/82

See application file for complete search history.

(56) References Cited

U.S. PATENT DOCUMENTS

| | | | | |
|---|---|---|---|---|
| 1,595,382 A * | 8/1926 | Coberly | F23D 14/82 | 431/346 |
| 5,099,879 A * | 3/1992 | Baird | F15D 1/02 | 137/561 A |
| 5,318,438 A * | 6/1994 | Sugahara | F23D 14/045 | 431/285 |
| 5,525,054 A * | 6/1996 | Nakaura | F23D 14/045 | 431/285 |
| 6,916,175 B2 * | 7/2005 | Cho | F23D 14/105 | 431/285 |
| 9,228,742 B2 * | 1/2016 | Akiyama | F23D 14/02 | |
| 10,184,658 B2 * | 1/2019 | Sugioka | F23D 14/26 | |
| 2012/0135360 A1 * | 5/2012 | Hannum | F23L 7/00 | 431/350 |
| 2012/0156629 A1 * | 6/2012 | Akiyama | F23D 14/04 | 431/354 |
| 2012/0244482 A1 * | 9/2012 | Homma | F23D 14/46 | 431/278 |

(Continued)

FOREIGN PATENT DOCUMENTS

JP 10-288315 A 10/1998

*Primary Examiner* — Avinash A Savani
*Assistant Examiner* — Martha M Becton
(74) *Attorney, Agent, or Firm* — Cermak Nakajima & McGowan LLP; Tomoko Nakajima

(57) ABSTRACT

[Problems] A flat burner elongated in the longitudinal direction has, at an upper end thereof, a main burner port (63) and a flame retention port (64) positioned at least on laterally one side of the main burner port (63). The flat burner uses hydrogen-containing fuel as a fuel. Flash back is prevented at the flame retention port in which the gas ejection speed becomes relatively small.

[Solving Means] A lean fuel-air mixture which is leaner in fuel concentration than a theoretical fuel-air ratio is ejected from the main burner port (63) and a gas containing only fuel is ejected from the flame retention port (64). In addition, the height, on the side of the main burner port (63), of the upper end of the flame retention port (64), is made lower than the height of the upper end of the main burner port (63).

1 Claim, 4 Drawing Sheets

(56) References Cited

U.S. PATENT DOCUMENTS

| | | | | |
|---|---|---|---|---|
| 2012/0308945 | A1* | 12/2012 | Wada | F23D 14/46<br>431/278 |
| 2013/0149653 | A1* | 6/2013 | Fukunishi | F23D 14/02<br>431/278 |
| 2013/0171576 | A1* | 7/2013 | Akiyama | F23D 14/02<br>431/354 |
| 2015/0184849 | A1* | 7/2015 | Akagi | F23D 14/46<br>431/278 |
| 2015/0253035 | A1* | 9/2015 | Naitoh | F23D 14/60<br>122/18.4 |
| 2016/0312999 | A1* | 10/2016 | Ojiro | F23D 91/00 |

* cited by examiner

【Fig. 1】
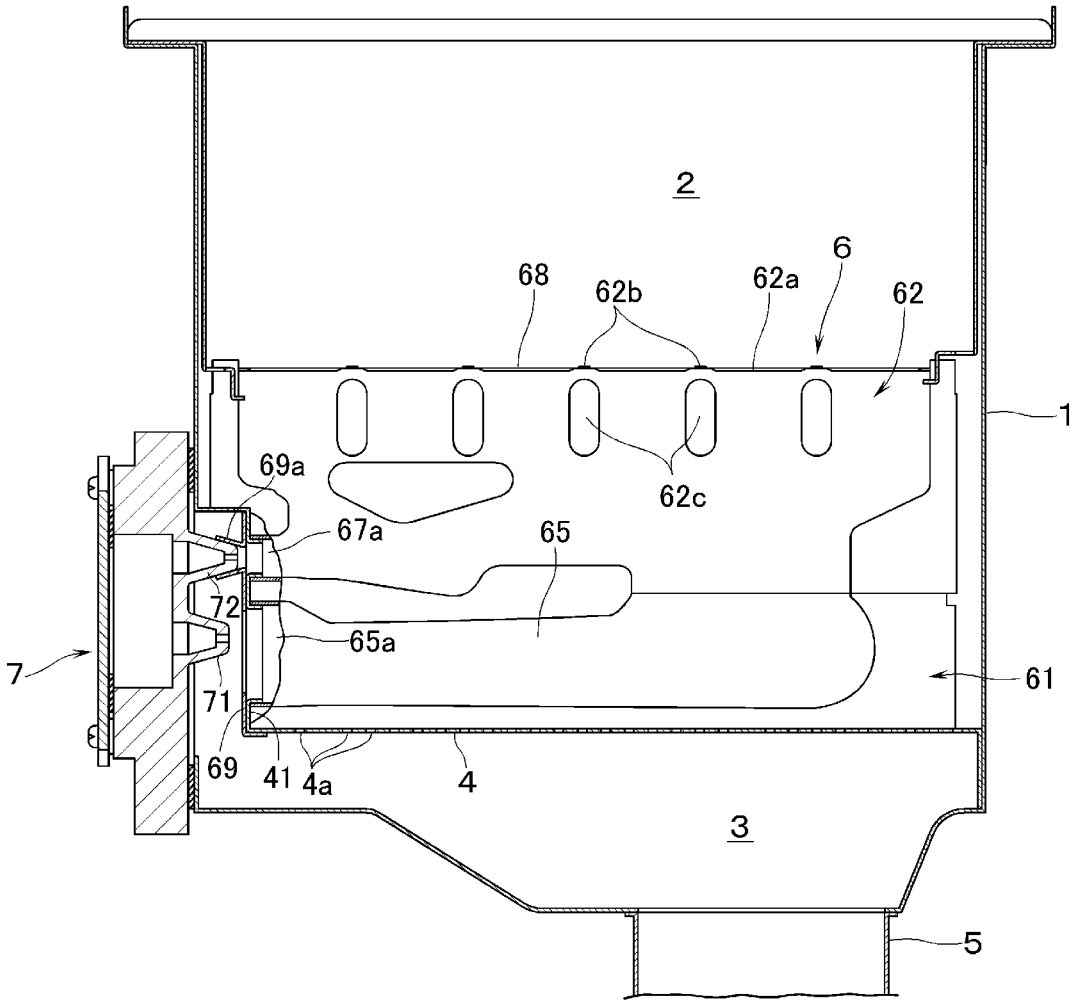

【Fig. 2】
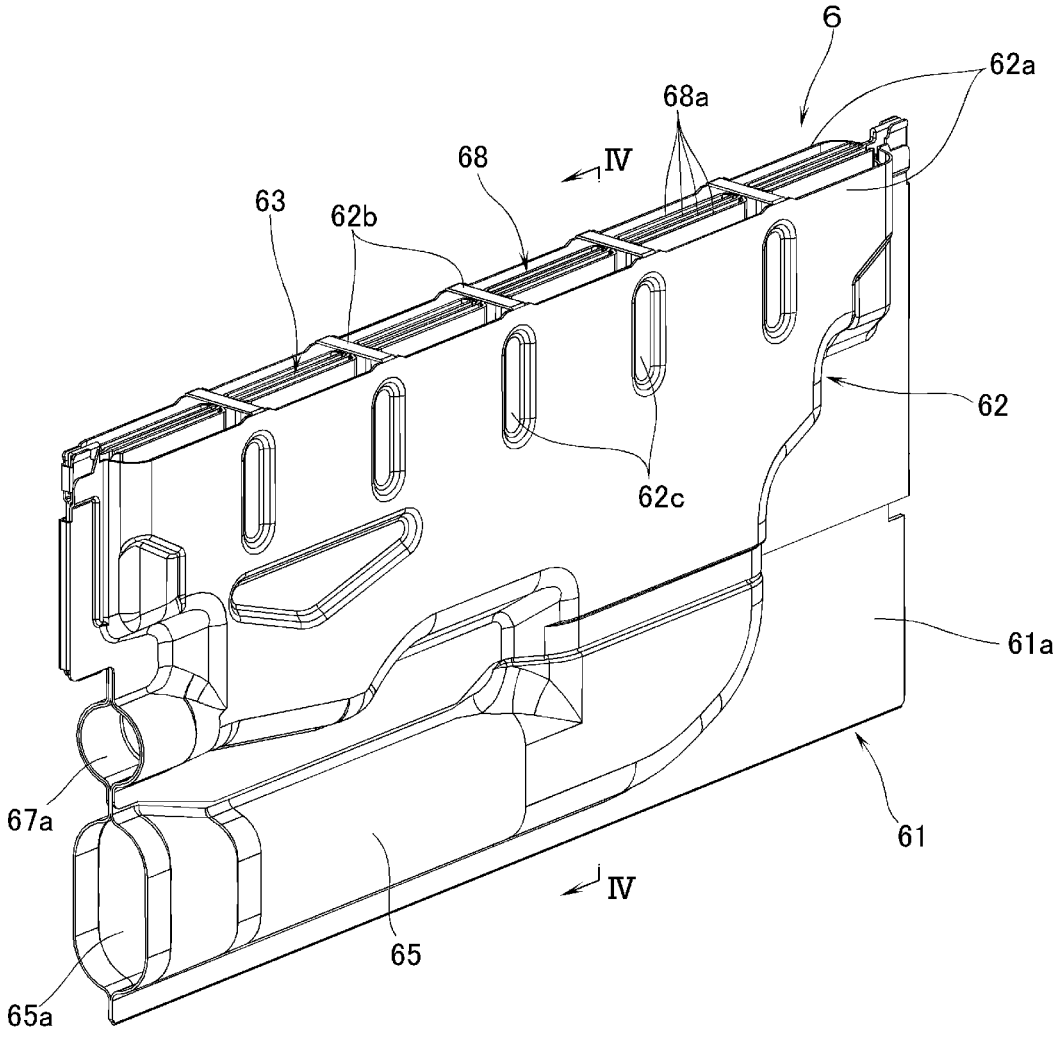

【Fig. 3】
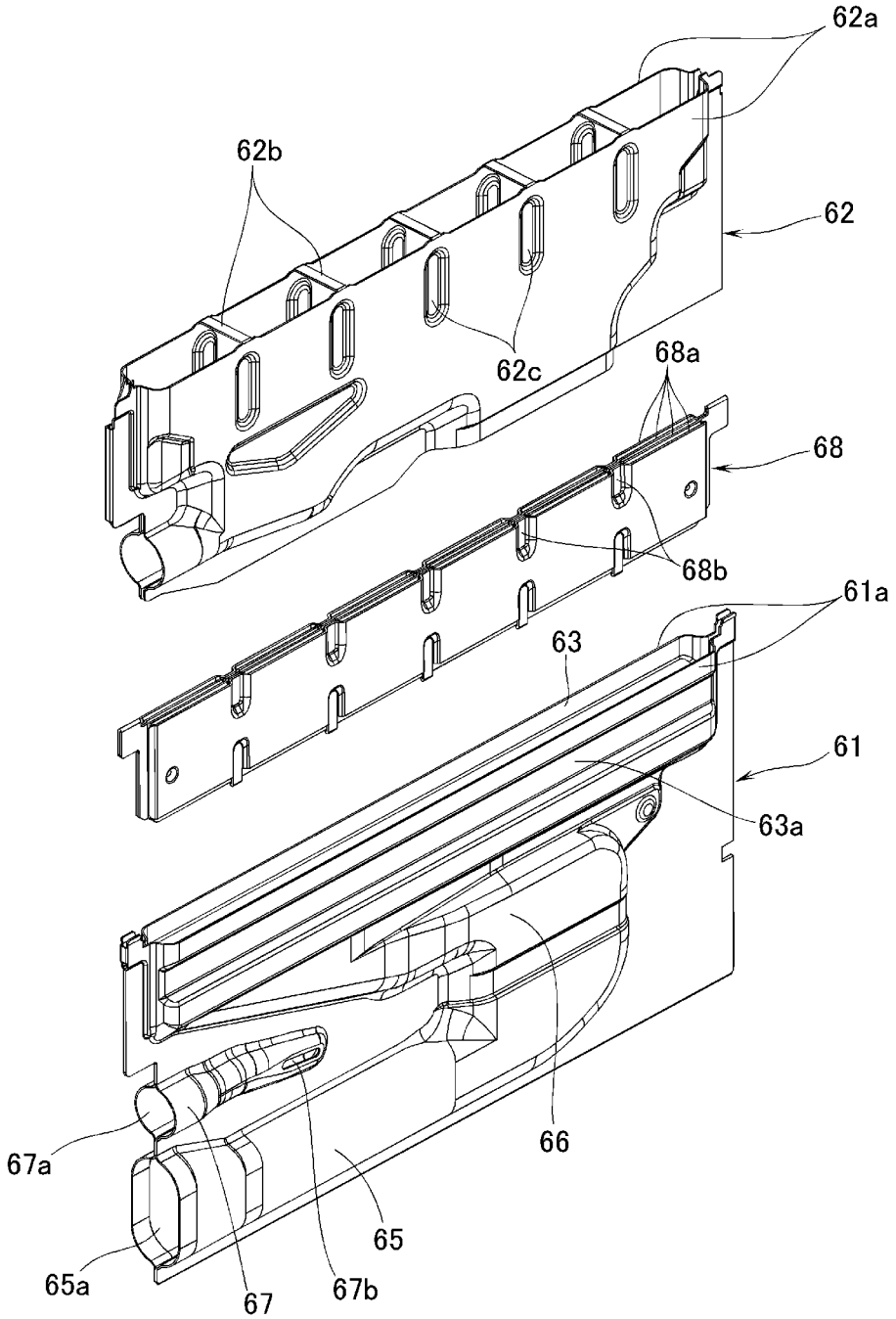

【Fig. 4】
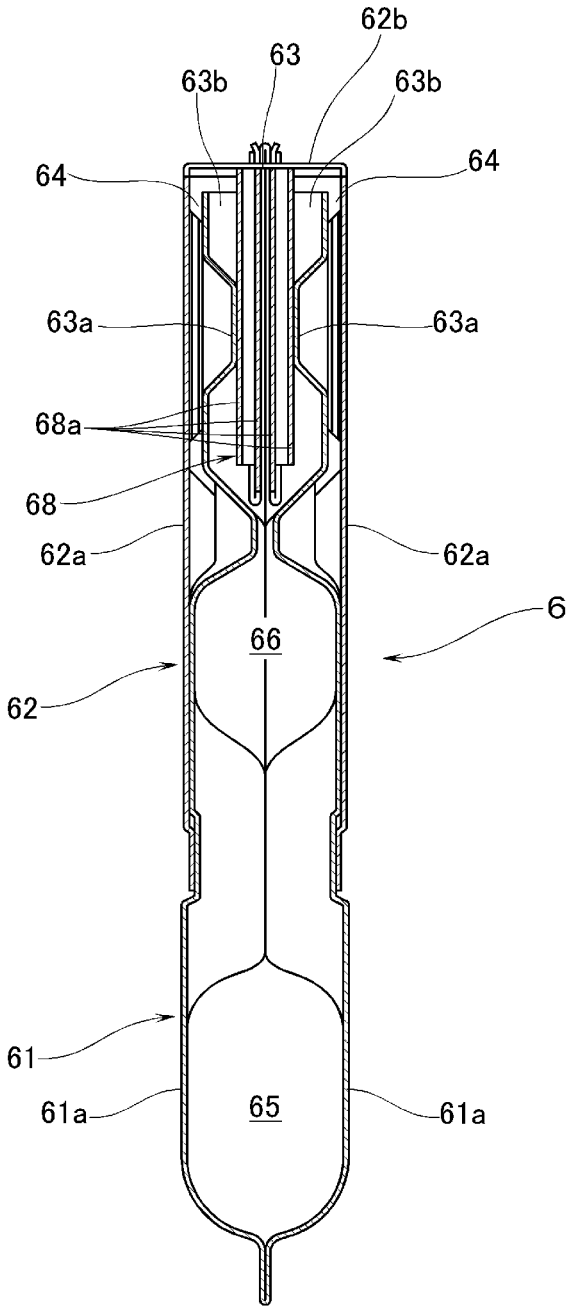

FLAT BURNER

BACKGROUND OF THE INVENTION

1. Technical Field

The present invention relates to a flat burner in which hydrogen-containing fuel is used as a fuel.

2. Background Art

In the related art, a flat burner elongated in a longitudinal direction has, at an upper end, a main burner port, and a flame retention port which is positioned on at least laterally one side of the main burner port, there are used fuels having methane gas, propane gas and the like as their principal components. In this arrangement, a lean fuel-air mixture which is leaner in fuel concentration than the theoretical fuel-air ratio is ejected from the main burner port. Then by lowering the main flame temperature to be generated by the combustion of the lean fuel-air mixture by the excess air that is included in the lean fuel-air mixture, the amount of generation of NOx is reduced. In addition, a small amount of a rich fuel-air mixture which is richer in fuel concentration than the theoretical fuel-air ratio is ejected from the flame retention port so that the main flame can be stabilized by the pilot flame that is generated by the combustion of the rich fuel-air mixture (see, e.g., JP-A-1998-288315).

By the way, as a consequence of recent trend toward recommendation to use renewable energy as a measure against global warming, it is estimated that power generation plants which utilizes wind power and photovoltaic power will increase, resulting in much increase in dump power. It is therefore necessary to take measure against dump power. As one measure, it is considered to store the dump power by converting it into hydrogen and to inject the hydrogen into gas pipelines so as to supply the resultant product as hydrogen-containing fuel which is capable of reducing the carbon dioxide output.

It is to be noted here that the following disadvantage will occur if the hydrogen-containing fuel is used as a fuel in the above-mentioned flat burner. In other words, the hydrogen-containing fuel has a very high combustion speed and is, therefore, likely to give rise to flash back at the flame retention port in which the gas ejection speed becomes relatively low.

SUMMARY

Problems that the Invention is to Solve

In view of the above points, this invention has a problem of providing a flat burner which uses, as a fuel, hydrogen-containing fuel and in which an arrangement is made to prevent a flash back at the flame retention port.

Means for Solving the Problems

In order to solve the above problem, this invention is a flat burner elongated in a longitudinal direction having, at an upper end thereof, a main burner port and a flame retention port positioned at least on laterally one side of the main burner port, the flat burner using hydrogen-containing fuel as a fuel. In this flat burner a lean fuel-air mixture gas which is leaner in fuel concentration than the theoretical fuel-air ratio is ejected from the main burner port, and a gas containing only fuel is ejected from the flame retention port.

According to this invention, since the gas containing only the fuel is ejected from the flame retention port, the pilot flame to be formed on the flame retention port will become diffusion flame. And it becomes possible to locate a region (to be described hereinafter) in a position relatively away from the upper end of the flame retention port, the region in question being the one in which a combustion reaction takes place of a mixture gas of theoretical fuel-air ratio that can attain the highest temperature and the highest combustion speed, and the region also being the one which is present between the pilot flame and the main flame that is formed by the combustion of the lean fuel-air mixture ejected from the main burner port, in which the mixture gas of theoretical fuel-air ratio is defined to be a mixture gas in which the ejected fuel from the flame retention port gets mixed with the excess air in the ejected lean fuel-air mixture from the main burner port. As a result, the temperature rise at the upper end of the flame retention port can be restrained, thereby preventing the flash back.

Further, in this invention it is preferable to keep the height of an upper end, on the side of the main burner port, of the flame retention port lower than the upper end of the main burner port. According to this arrangement, the position in which the excess air in the lean mixture gas ejected from the main burner port starts to get mixed with the fuel ejected from the flame retention port becomes away, by the difference in height between the flame retention port and the main flame port, from the upper end, on the side of the main burner, of the flame retention port. Therefore, the region in which combustion takes place of the mixture gas of theoretical fuel-air ratio that is present between the main flame and the pilot flame can be moved further away from the upper end, on the side of the main burner port, of the flame retention port, thereby ensuring the prevention of flash back.

BRIEF DESCRIPTION OF THE DRAWINGS

FIG. 1 is a sectional side view of a combustion apparatus equipped with a flat burner of an embodiment according to this invention.

FIG. 2 is a perspective view of the flat burner according to this embodiment.

FIG. 3 is an exploded perspective view of the flat burner according to this embodiment.

FIG. 4 is a sectional view of the flat burner taken along the line IV-IV in FIG. 2.

DESCRIPTION OF PREFERRED EMBODIMENTS

With reference to FIG. 1, reference numeral 1 denotes a combustion box which constitutes a combustion apparatus such as a heat source apparatus for supplying hot water, and the like. The upper surface of the combustion box 1 is left open and an object to be heated such as a heat exchanger and the like (not illustrated) is disposed on top of the combustion box 1. Inside the combustion box 1 there is provided a partition plate 4 which partitions the space inside the combustion box 1 into a combustion chamber 2, and an air supply chamber 3 which lies on the lower side of the combustion chamber 2. The bottom surface of the air supply chamber 3 has connected thereto a fan (not illustrated) through a duct 5 so that air can be supplied from the fan to the air supply chamber 3. The partition plate 4 has formed therein a multiplicity of distribution holes 4*a* so that the air supplied to the air supply chamber 3 can be supplied as secondary air to the combustion chamber 2 through these distribution holes 4*a*.

A plurality of flat burners 6, elongated in the longitudinal direction, are disposed inside the combustion chamber 2 laterally side by side with one another. A riser portion 41 is formed in a bent manner at the front edge of the partition plate 4. A manifold 7 is mounted at the front side of the riser portion 41 in a manner to block the lower front face of the combustion box 1. The manifold 7 is provided with gas nozzles 71, 72 which face inlet ports 65*a*, 67*a* of inlet pipe portions 65, 67 of each of the flat burners 6 as described hereinafter.

As shown in FIGS. 2 through 4, the flat burner 6 according to the embodiment of this invention is provided with a longitudinally elongated burner main body 61, and a burner cap 62 which is covered on top of the burner main body 61. A rectangular main burner port 63 which opens upward is formed at an upper end of the burner main body 61. By means of the burner cap 62 there is formed a flame retention port 64 which is positioned on laterally each side of the main burner port 63.

The burner main body 61 is made up of a pair of side plates 61*a*, 61*a* which lie laterally opposite to each other. The side plates 61*a*, 61*a* are formed by bending a single piece of plate into a shape of a principal rafter along a bending line which forms a bottom edge of the burner main body 61. Then, by means of press working of each side plate 61*a*, there are formed in the burner main body 61: the main burner port 63 on an upper end; an inlet pipe portion 65 for main flame at a lower part thereof; and a distribution chamber portion 66 which introduces the gas from the inlet pipe portion 65 for main flame into the main burner port 63.

The inlet pipe portion 65 for main flame is elongated backward from an inlet port 65*a* which is positioned in a lower front edge of the burner main body 61. From the rear end of the inlet pipe portion 65 for main flame, the distribution chamber portion 66 is elongated upward while being expanded forward. At the front part of the burner main body 61 there is formed an inlet pipe portion 67 for pilot flame in a position between the inlet pipe portion 65 for main flame and the distribution chamber portion 66. This inlet pipe portion 67 for pilot flame ends up by extending slightly backward from an inlet port 67*a* that is located at the front end of the burner main body 61, and at a side surface of the rear end part thereof, there is formed a ventilation hole 67*b*.

The burner cap 62 has: a pair of side plates 62*a*, 62*a* which are covered onto an outside of the pair of side plates 6*a*, 61*a* of the burner main body 61; and a plurality of bridge portions 62*b* which connect the side plates 62*a*, 62*a* together at the upper edges thereof. Between the side plate 61*a* of the burner main body 61 and the side plate 62*a* of the burner cap 62, there are defined: the flame retention port 64 at an upper edge portion; and a passage which introduces the gas into the flame retention port 64, the gas being escaped from the inlet pipe portion 67 for pilot flame to the outside of the burner main body 61 through the ventilation hole 67*b*. In addition, in a plurality of longitudinal positions of the side plate 62*a* of the burner cap 62, there are formed recessed portions 62*c* which are in contact with the outside surface of the side plate 61*a* of the burner main body 61 in a manner to longitudinally segregate the flame retention port 64.

Inside the main burner port 63, there is mounted a straightening member 68 having a plurality of straightening plates 68*a* which are laterally disposed in parallel with one another. The straightening member 68 has formed, in a plurality of longitudinal positions coinciding with the bridge portions 62*b* of the burner cap 62, contact portions 68*b* in which the straightening plates 68*b* are brought into contact with one another so that the flame port passages to be defined between each of the straightening plates 68*a* are segregated in the longitudinal direction. In addition, at an upper part of the side plates 61*a* of the burner main body 61 there are formed longitudinally elongated recessed portions 63*a* which come into contact with the outside surfaces of the straightening member 68. In this manner, between those portions of the side plates 61*a* which are positioned above the recessed portions 63*a* and the straightening member 68, there are defined blind clearances 63*b* which are free from ejection of the gas. It is thus so arranged that the gas to be ejected out of the main burner ports 63 is partly recirculated into the above of the blind clearances 63*b*.

The flat burner 6 of this embodiment uses hydrogen-containing fuel as a fuel. It is to be noted here that the hydrogen-containing fuel has a very high combustion speed and therefore that a flash back is likely to occur at the flame retention port 64 at which the gas ejection speed becomes relatively low.

As a solution, in this embodiment, an arrangement has been made that a lean fuel-air mixture gas which is leaner in fuel concentration than the theoretical fuel-air ratio, e.g., the lean fuel-air mixture whose air ratio is 2.0 or above is ejected from the main burner ports 63, and that gas containing only fuel is ejected from the flame retention port 64. With reference to FIG. 1, the inlet port 65*a* of the inlet pipe portion 65 for main flame receives an inflow of fuel injected from the gas nozzle 71 for the main flame that lies opposite to the inlet port 65*a* and also receives the inflow of the air. This fuel and the air get mixed and the resultant lean fuel-air mixture to be generated, is ejected out of the main burner port 63. Further, a damper 69 that is overlapped on the front face of the riser portion 41 at the front edge of the partition plate 4 has disposed, in a projecting manner, a shielding sleeve 69*a* into which is fitted the front end portion of the gas nozzle 72 for pilot flame. In this manner, it is so arranged that the air does not flow into the inlet port 67*a* of the inlet pipe portion 67 for pilot flame. Due to this arrangement, only the fuel that is ejected from the gas nozzle 72 for pilot flame flows into the inlet port 67*a* of the inlet pipe portion 67 for pilot flame. As a result, gas made up of only the fuel is ejected from the flame retention port 64.

If the excess air ratio of the lean fuel-air mixture is made to be above 2.0, even with hydrogen-containing fuel that has a high combustion speed, the flame (main flame) will be formed in a position sufficiently away from the upper end of the main burner port 63. As a result, the temperature increase at the upper end of the main burner port 63 can be restrained, thereby preventing the flash back from occurring at the main burner port 63.

In addition, since the gas containing only the fuel is ejected from the flame retention port 64, the pilot flame to be formed on the flame retention port 64 will become diffusion flame in which combustion takes place of a mixture gas having mixed the excess air in the ejected lean fuel-air mixture from the main burner port 63 and the secondary air in the circumference of the flame retention port 64 into the ejected fuel from the flame retention port 64. And it becomes possible to locate a region (to be described hereinafter) in a position relatively away from the upper end of the flame retention port 64, the region in question being the one in which a combustion reaction takes place of a mixture gas of theoretical fuel-air ratio that can attain the highest temperature and the highest combustion speed and also being the one which is present between the pilot flame and the main flame that is formed by the combustion of the lean fuel-air mixture ejected from the main burner port 63. As a result, the temperature rise at the upper end of the flame retention port 4 can be restrained, thereby preventing the flash back.

Further, according to this embodiment, the upper-end height, on the side of the main burner port 63, of the flame retention port 64 (coinciding with the height of the upper end of the side plate 61*a* of the burner main body 61), is made lower than the height of the upper end of the main burner port 63 (coinciding with the upper-end height of the straightening member 68). According to this arrangement, the position in which the excess air in the lean fuel-air mixture ejected from the main burner port 63 starts to be mixed with the fuel ejected from the flame retention port 64, will be made away from the upper end, on the side of the main burner port 63, of the flame retention port 64 by the difference in height between the flame retention port 64 and the main burner port 63. As a result, the region in which the mixture gas, of the theoretical fuel-air ratio, present between the main flame and the pilot flame is combusted, can be made away from the upper end, on the side of the main burner port 63, of the flame retention port 64, thereby improving the surety of flash back prevention.

Descriptions have so far been made, with reference to the drawings, of the embodiment of the invention, but this invention shall not be limited to the above. For example, in the above-mentioned embodiment, the upper-end height, on the side opposite to the side of the main burner port 63, of the flame retention port 64 (coinciding with the upper-end height of the side plate 62*a* of the burner cap 62) is made higher than the height of the upper end, on the side of the main burner port 63 of the flame retention port 64, and is made to be slightly lower than the height of the upper end of the main burner port 63. This invention shall not be limited to the above. In other words, the height of the upper end, on the side opposite to the side of the main burner port 63, of the flame retention port 64 may be made equivalent to the height of the upper end, on the side of the main burner port 63, of the flame retention port 64, or may be made equivalent to the height of the upper end of the main burner port 63. What is important is that the height of the upper end, on the side opposite to the side of the main burner port 63, of the flame retention port 64 may be equivalent to, or above, the height of the upper end, on the side of the main burner port 63, of the flame retention port 64, and also may be equivalent to, or less than, the height of the upper end of the main burner port 63. Further, although the flat burner 6 of the above-mentioned embodiment is provided with flame retention ports 64 on laterally both sides of the main burner port 63, it may alternatively be so arranged that the flame retention port is provided only on laterally one side of the main burner port. Still furthermore, the hydrogen-containing fuel may contain compositions other than hydrogen or may not contain compositions other than hydrogen.

DESCRIPTION OF REFERENCE MARKS

6 flat burner 63 main burner port 64 flame retention port

What is claimed is:

1. A flat burner elongated in a longitudinal direction comprising:

a main burner body comprising a pair of side plates which lie laterally opposite to each other;

a burner cap thereon, the burner cap comprising a pair of side plates arranged onto an outside of the pair of side plates of the main burner body; and a main burner port at an upper end of the burner main body, a straightening member mounted within the main burner port; and a flame retention port positioned on laterally each side of the main burner port, wherein the flame retention port is formed between the side plate of the burner main body and the side plate of the burner cap such that the upper-end height, on the side of the main burner port, of the flame retention port coinciding with the height of the upper end of the side plate of the burner main body, is made lower than the height of the upper end of the main burner port coinciding with the upper-end height of the straightening member, the flat burner using hydrogen-containing fuel as a fuel, wherein a lean fuel-air mixture gas which is leaner in fuel concentration than a stoichiometric fuel-air ratio is ejected from the main burner port and a gas containing only fuel which is the hydrogen-containing fuel is ejected from the flame retention port.

* * * * *